US009546084B2

(12) United States Patent
Meinzinger et al.

(10) Patent No.: US 9,546,084 B2
(45) Date of Patent: Jan. 17, 2017

(54) APPARATUS FOR THE EMPTYING OF CONTAINERS

(71) Applicant: KRONES AG, Neutraubling (DE)

(72) Inventors: Rupert Meinzinger, Kirchroth (DE); Ute John-Unterburger, Suenching (DE)

(73) Assignee: KRONES AG (DE)

( * ) Notice: Subject to any disclaimer, the term of this patent is extended or adjusted under 35 U.S.C. 154(b) by 0 days.

(21) Appl. No.: 14/650,223

(22) PCT Filed: Dec. 5, 2013

(86) PCT No.: PCT/EP2013/075650
§ 371 (c)(1),
(2) Date: Jun. 5, 2015

(87) PCT Pub. No.: WO2014/086920
PCT Pub. Date: Jun. 12, 2014

(65) Prior Publication Data

US 2015/0344280 A1 Dec. 3, 2015

(30) Foreign Application Priority Data

Dec. 5, 2012 (DE) ..... 10 2012 111 850

(51) Int. Cl.
*B67D 1/00* (2006.01)
*B67D 1/08* (2006.01)

(52) U.S. Cl.
CPC ..... *B67D 1/0001* (2013.01); *B67D 1/0829* (2013.01)

(58) Field of Classification Search
CPC ..... B67D 1/0001; B67D 1/0829
(Continued)

(56) References Cited

U.S. PATENT DOCUMENTS

| | | | | | |
|---|---|---|---|---|---|
| 1,880,354 | A * | 10/1932 | Mueller | F41B 9/0009 | 124/71 |
| 4,136,801 | A * | 1/1979 | Pavenick | B65D 83/0011 | 222/105 |
| 4,375,864 | A * | 3/1983 | Savage | B65D 77/067 | 141/349 |
| 4,456,134 | A * | 6/1984 | Cooper | B65D 1/0292 | 215/12.1 |
| 5,139,169 | A * | 8/1992 | Boyer | B67D 1/0001 | 100/288 |
| 5,206,037 | A * | 4/1993 | Robbins, III | B29C 53/08 | 264/295 |
| 5,505,336 | A * | 4/1996 | Montgomery | B67D 1/0001 | 222/326 |
| 5,730,327 | A * | 3/1998 | Stern | A47K 5/1209 | 222/105 |
| 2003/0102333 | A1* | 6/2003 | Wright | B65D 77/067 | 222/340 |
| 2006/0054641 | A1* | 3/2006 | Evers | B67D 1/0001 | 222/326 |
| 2009/0194561 | A1* | 8/2009 | Quasters | B65D 1/0276 | 222/1 |

(Continued)

FOREIGN PATENT DOCUMENTS

| | | | | |
|---|---|---|---|---|
| DE | 20321260 | 7/2006 | ..... | B67D 1/08 |
| EP | 0250640 | 1/1988 | ..... | B67B 7/86 |

(Continued)

OTHER PUBLICATIONS

International Search Report (no translation) issued in application No. PCT/EP2013/075650, dated Apr. 23, 2014 (11 pgs).

(Continued)

*Primary Examiner* — Donnell Long
(74) *Attorney, Agent, or Firm* — Hayes Soloway P.C.

(57) ABSTRACT

An apparatus for the removal of liquids from deformable containers, with a first holding device for holding a first region of a container and with a second holding device for holding a second region of the container, wherein this (Continued)

second region is arranged at a distance from the first region, with a removal device for removing liquid from the container and with a drive device which moves the second holding device in a pre-set direction of movement (L) with respect to the first holding device. The removal device is arranged on the apparatus in a removable manner and at least one element of the removal device is designed in the form of a one-way element.

19 Claims, 5 Drawing Sheets

(58) Field of Classification Search
USPC .... 222/464.1, 529, 81, 82, 527, 95, 545, 89, 222/541.2, 541.6, 153.05–153.08, 222/567–570, 105, 464.3, 464.4, 222/464.7
See application file for complete search history.

(56) References Cited

U.S. PATENT DOCUMENTS

2012/0104020 A1* 5/2012 Cur ..... B67D 1/0001 222/1

FOREIGN PATENT DOCUMENTS

| | | | |
|---|---|---|---|
| GB | 2131885 | 6/1984 | ..... B65D 83/00 |
| GB | 2436828 | 10/2007 | ..... B67D 1/00 |
| WO | WO9911561 | 3/1999 | ..... B67D 1/04 |
| WO | WO0194251 | 12/2001 | ..... B67D 1/04 |
| WO | WO03097519 | 11/2003 | ..... B67D 1/00 |
| WO | WO2005113418 | 12/2005 | ..... B67D 1/14 |
| WO | WO2010014004 | 2/2010 | ..... B67D 1/08 |
| WO | WO2011061343 | 5/2011 | ..... B67D 1/00 |

OTHER PUBLICATIONS

German Search Report (no translation) issued in application No. 10 2012 111 850.7, dated Jun. 14, 2013 (5 pgs).

Disposable Female Luer-Lock Syringes product description, CODAN Medizinische Geräte GmbH & Co KG, Lensahn, 2010 (2 pgs).

Produktkatalog Applikationstechnik und -systeme—Infusion and Parenterale Ernährung (no translation), Bad Homburg v.d.H, 2011 (87 pgs).

* cited by examiner

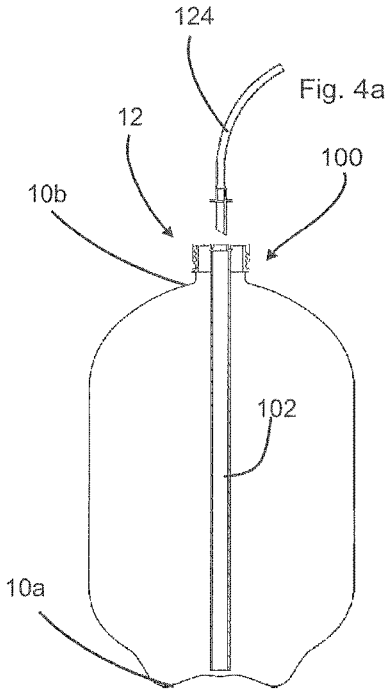
Fig. 4a
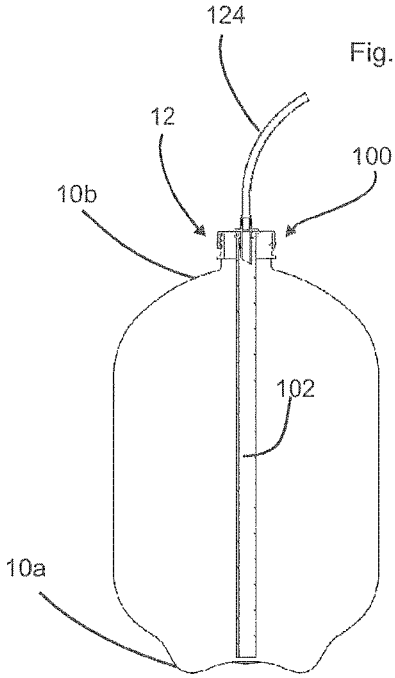
Fig. 4b
Fig. 4c
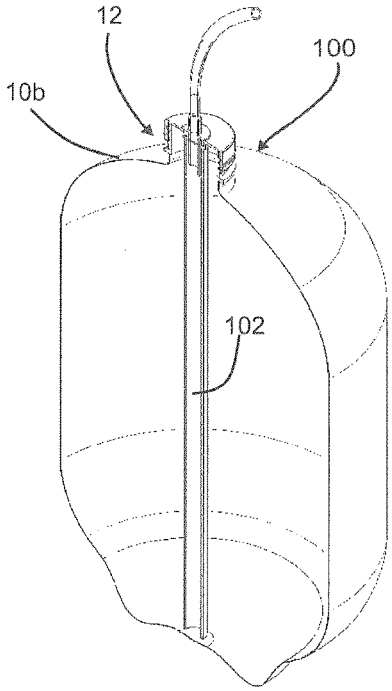
Fig. 4d
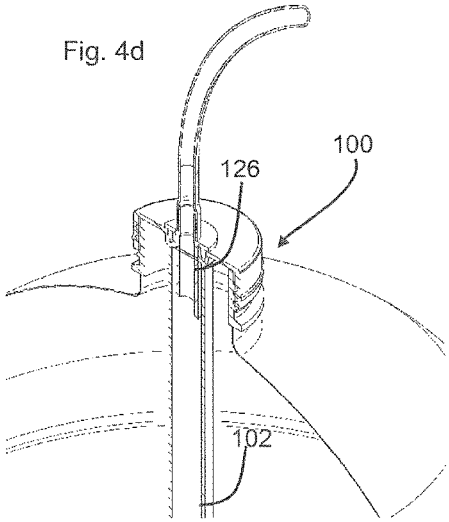

Fig. 5a
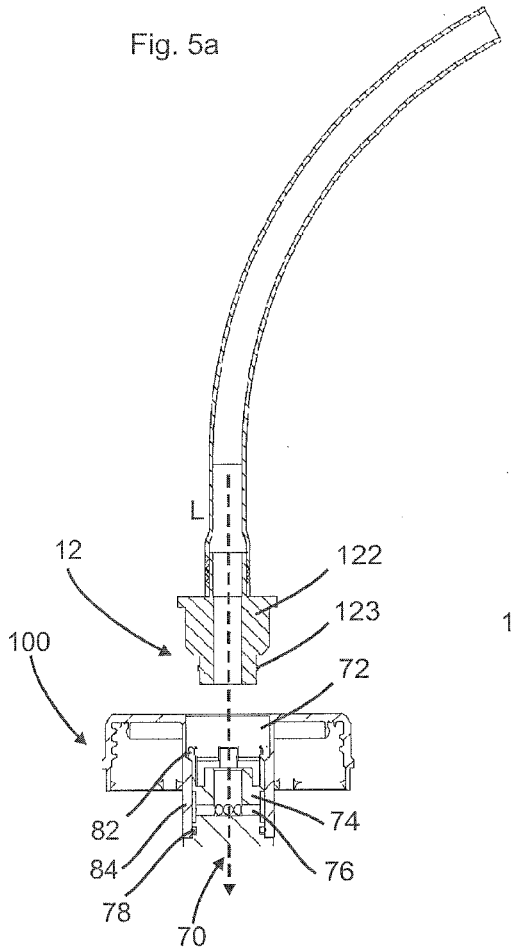
Fig. 5b
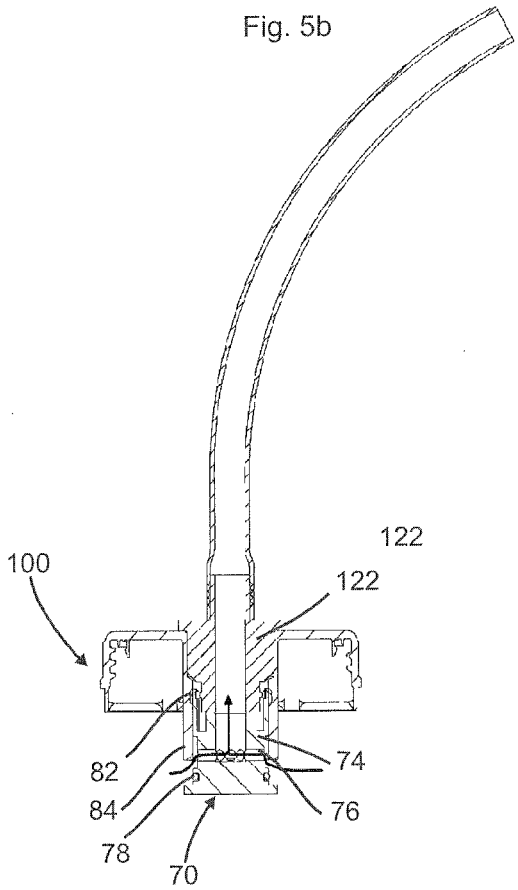
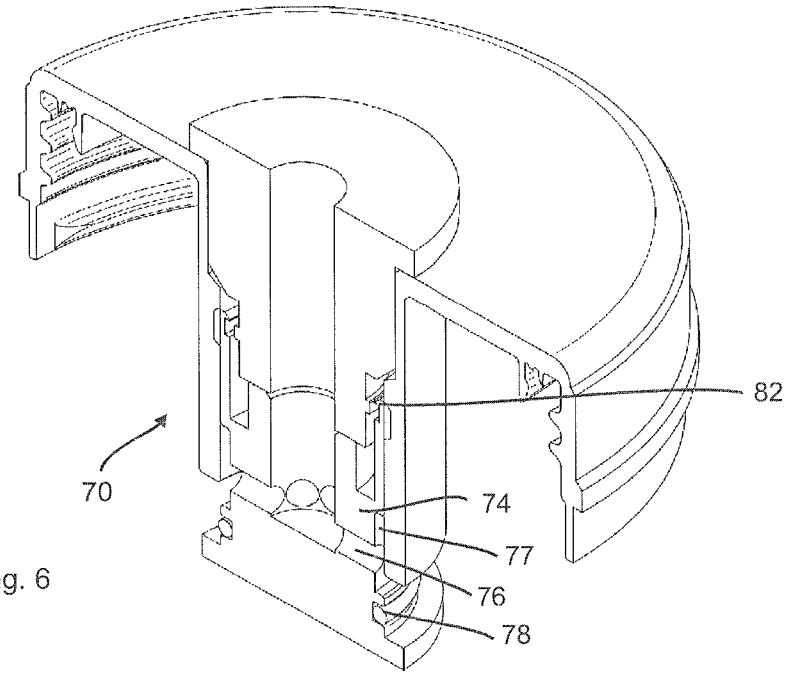
Fig. 6

APPARATUS FOR THE EMPTYING OF CONTAINERS

BACKGROUND OF THE INVENTION

The present invention relates to an apparatus for the emptying of containers. Apparatus of this type have long been known from the prior art, for example in the form of drawing systems. In this way, apparatus are known for example in which the emptying of the containers is carried out in such a way that gas is fed into the container and so the liquid is forced out of the container by the over-pressure which occurs. In addition, in recent years apparatus have become known in which the emptying of the container is carried out by this container being compressed and the liquid present in the interior being forced out of the container in this way.

The problem arises in the case of drawing systems of this type that the component parts thereof are frequently very difficult to clean and large quantities of chemicals also have to be used for the purpose of cleaning.

The object of the present invention is therefore to make cleaning procedures simpler for systems of this type and possibly to be able to dispense with them completely.

SUMMARY OF THE INVENTION

An apparatus according to the invention for the removal of liquids from deformable containers has a first holding device for holding a first region of a container as well as a second holding device for holding a second region of the container, this second region being arranged at a distance from the first region. In addition, the apparatus has a removal device for removing liquid from the container as well as a drive device which moves the second holding device in a pre-set direction of movement with respect to the first holding device.

According to the invention the removal device is arranged on the apparatus in a removable manner and at least one element of the removal device is designed in the form of a single-use element.

It is advantageous in this case for the deformable container to be a plastics material container, in particular of PET. It would also be possible, however, for the container to be produced from another deformable material.

It is therefore proposed that the removal device should be disposable at least in part or should not, as customary in the prior art, remain on the apparatus respectively. In this way, a complicated cleaning procedure for this removal device can be avoided.

In the case of a further advantageous embodiment only one flow connection (i.e. in particular exclusively only one flow connection) is present between the interior of the container and an external space of the container during the removal of the liquid from the container. In a manner differs from what is customary in the prior art, no further connection—such as a further line, for example a gas pressure line—is therefore provided in this case, but only the aforesaid liquid line. In particular, the aforesaid single flow connection is thus the liquid connection by way of which the liquid is removed from the container.

In the case of a further advantageous embodiment the removal device has a flexible hose element. In many comparable systems the removal device is designed in a rigid manner in the form of a tube and is frequently also incorporated in the apparatus in a fixed manner. In particular, this hose element is a single-use hose element.

In the case of a further advantageous embodiment the removal device has a flow connection body which projects at least locally into the container in order to remove the liquid. In this case it is possible for a tubular body for example, which is a component part of the flow connection body, to project into the liquid during the removal thereof or at least to project into the interior of the container.

It is advantageous for the hose connection to be attached to this flow connection body at least indirectly and preferably directly. In this case it is possible for the hose element to be plugged into the flow connection body, but it would also be possible for the hose element to be screwed to the flow connection body.

In the case of a further advantageous embodiment the flow connection body is designed in the form of a piercing device or has such a piercing device, which in order to produce the flow connection with the interior of the container pierces a closure or at least a wall of the container.

In the case of this embodiment it is possible for the plastics material cover of the container or the closure respectively to be pierced for example with the aid of a piercing needle and for the medium to be tapped by means of a plastics material line, and in particular a single-use plastics material line. In this case it is advantageous for this piercing needle to be formed in such a way that a round circular portion of the cover is not quite torn off on account of this shaping and thus does not fall into the liquid. After the complete emptying of the container, which preferably cannot be re-closed, the single-use line and the piercing means or the piercing needle respectively are dispensed with. A new line, and preferably also a new piercing means, are ready for a further container. It is preferable for the piercing device to consist of a plastics material, since an inexpensive production as well as a simple disposal after use is made possible as a result. In this case the plastics material of the piercing device preferably has, in particular, a greater degree of strength than the material of the closure.

In the case of a further advantageous embodiment the apparatus has a carrier on which at least one holding device is arranged in a releasable manner. It is advantageous for carriers to be provided in each case on which the two holding devices are arranged in a releasable manner, so that the apparatus can be adapted to different containers.

In the case of a further advantageous embodiment it would also be possible for the closure to have a tubular body, for example in the manner of a cannula, which allows the complete emptying of the container during "the mechanical emptying", i.e. during the deformation of the container. In this case, during a complete emptying, this tubular body can press the base of the container downwards slightly in order to remove the residual liquid as well. It is also preferable in this case for the piercing means and the closure to be dispensed with. In this case, however, the container is preferably open.

The present invention further relates to a removal arrangement for the removal of liquids from containers, and in particular from deformable containers, which has an apparatus for the removal of liquids, which in turn has a first holding device for holding a first region of the container, and a second holding device for holding a second region of the container, the second region being arranged at a distance from the first region. In addition, the removal arrangement has a removal device for removing liquid from the container.

According to the invention the container has in this case a closure to which a tubular body for the removal of the liquid is attached in the interior of the container. This tubular body can be for example a hose which extends as far as a base of the container. It can also, however, be a fixed tube, it being preferable in this embodiment for the container not to be compressed or deformed respectively during the removal procedure. It is advantageous, in particular on the closure, for a sealing segment to be provided which closes this tubular body which extends in the interior of the container. It is advantageous for this tubular body to act as an ascending pipe for the liquid, in particular when the latter is removed or when the liquid is forced out of the container on account of the pressure supplied.

In this way, the medium is emptied in this case by means of a tube or a long cannula respectively, which preferably extends almost as far as the base of the container, in which case in particular an additional gas supply can also take place. On account of the supply of gas the pressure in the container rises and the medium is emptied by way of the aforesaid cannula. The piercing is carried out with the aid of a piercing member as in the manner described above. In contrast to the embodiment described above, a further flow connection is therefore present in this case between the interior of the container and the external space thereof, in particular in the form of the gas connection.

It is advantageous for the removal device to be arranged on the apparatus in a removable manner and for at least one element of the removal device to be designed in the form of a single-use element. It is therefore also proposed in the case of this embodiment that the removal device should have single-use components. It is therefore also preferable in this case for the hose line and preferably also the piercing needle or the piercing means respectively to be changed after each change of container.

In the case of a further advantageous embodiment the removal device has a flow connection body which is capable of being inserted at least locally into the tubular body. In this embodiment it is preferable—as stated—for a piercing means again to be provided which, however, is adapted in terms of its cross-section to the tubular body in such a way that it can also be inserted into this tubular body in the interior of the container.

In the case of a further advantageous embodiment the closure of the container has a valve device. It is advantageous for this valve device to be opened by a movement of the removal device, and in particular an insertion or introduction respectively of the removal device or the flow connection body respectively. This is described in greater detail below with reference to the figures. In this way, it is possible for example for the container to be closed by the valve with an inserted seal and preferably to be filled by way of this valve. In addition, the valve can automatically be pulled upwards and thus closed for example by a special impression in the filling ram or the removal device respectively after the complete filling.

During an emptying procedure the valve is pushed downwards by a removal device or a ram respectively, to which the single-use line is attached, and the container can be emptied. It is also preferable in this case for the removal device to be dispensed with the form of a single-use element and to be capable of being disposed of after the container has been completely emptied. It would also be possible, however, for the valve to be closed again before the container has been completely emptied.

In the case of a further embodiment it would also be possible for the container closure to have two closure elements arranged one above the other in the piercing direction. In this case it is possible for the two closure elements to have openings in each case which in this way are offset from each other in the longitudinal direction of the container.

In the case of a further preferred embodiment it would be possible for the valve in the container closure to be designed in the form of a non-return valve which preferably closes automatically if a removal device is not inserted. In the case of a further advantageous embodiment the closure has at least one element which is movable with respect to another element of the closure and, in particular, is also movable in a longitudinal direction of the container or a piercing device of the piercing element respectively.

In the case of a further advantageous embodiment the closure also has a springing element which forces the valve into a closed or an opened position respectively, but preferably into a closed position. This can be a springing device which consists of a plastics material. In the case of a further advantageous embodiment the closure has an element capable of being pierced, and in particular a foil-like element.

BRIEF DESCRIPTION OF THE DRAWINGS

Further advantages and embodiments are evident from the accompanying drawings. In the drawings

FIGS. 4*a* to 4*d* are four illustrations of an apparatus according to the invention in a third embodiment;

FIGS. 5*a*, 5*b* are two illustrations of an apparatus according to the invention in a fourth embodiment, and FIG. 6 is an illustration of a closure with a valve device.

DETAILED DESCRIPTION OF THE INVENTION

Figure 1:
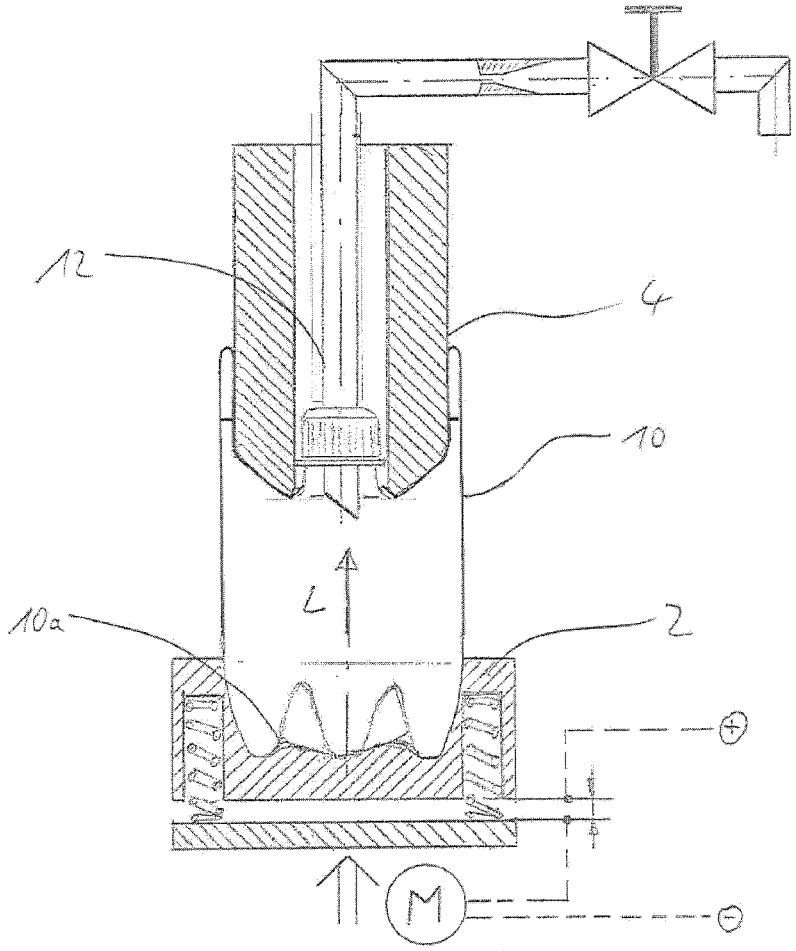
FIG. 1 is a diagrammatic illustration of an apparatus according to the invention.

FIG. 1 is a diagrammatic illustration of an apparatus according to the invention for the removal of liquid from a container 10 in a diagrammatic illustration. In this case the apparatus has a first holding device 2 here which is used for holding a first region 10*a* of the container. This first region 10*a* of the container is in this case a base region.

In addition, a second holding device 4 is provided which receives a second region of the container, in this case in particular an aperture region of the container which also contains the aperture, by way of which the liquid can be removed from the container. In addition, the apparatus has a drive device (not shown in detail) which moves the first holding device with respect to the second holding device in the longitudinal direction L of the container. The reference number 12 designates the removal device, by means of which liquid can be removed from the container.

Figure 2A:
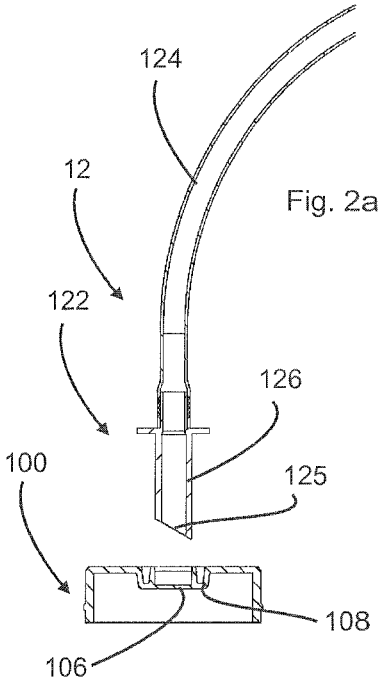
FIGS. 2*a* to 2*c* are three illustrations of an apparatus according to the invention in a first embodiment.
Figure 2B:
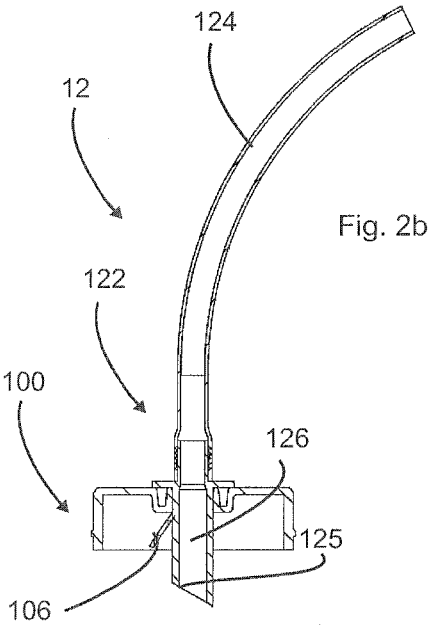
Figure 2C:
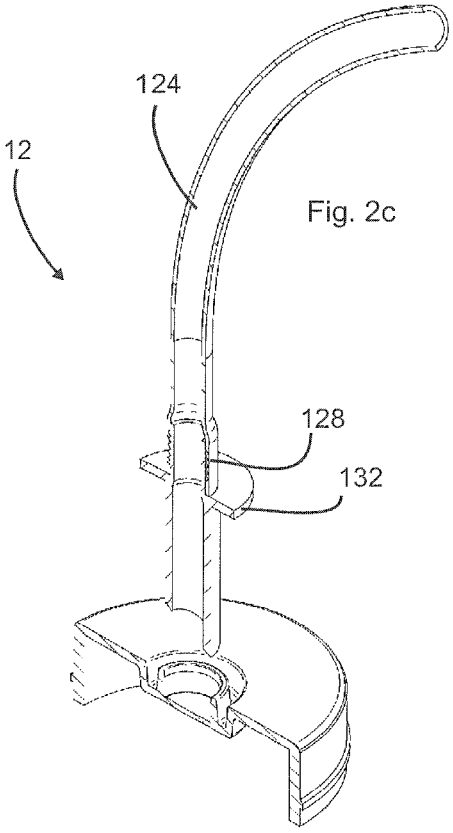

FIGS. 2*a* to 2*c* show a first embodiment of a removal device 12 according to the invention. In this case this removal device 12 has a flow connection body 122 which produces a flow connection between a hose 124 and the interior of the container. The removal device is produced from a plastics material which has a greater degree of strength than the closure material. In this embodiment the removal device is produced from POM (polyoxymethylene) which has a greater degree of strength than a closure of PP (polypropylene) for example.

This flow connection body 122 has in this case a cutting element 126 which is designed in a tubular manner and which has an oblique cutting edge 125. This cutting edge 125 is used for piercing a sealing closure 106 which is arranged on a recess 108 of a container closure 100. In this case this recess 108 is designed in such a way that it receives the flow connection body 122 or the cutting element 126 respectively with a precise fit.

FIG. 2*b* shows a situation in which the flow connection body 122 has been inserted into the closure 100. In this case the cutting edge 125 has pierced the closure or the seal 106 respectively. In this case, however, the seal 106 is not completely severed by the oblique design of the cutting edge 125 but remains suspended in a region on the closure, so that it does not drop into the liquid.

FIG. 2*c* is a further illustration of the removal device 12. In this case a disc-shaped cover element 132 which likewise rests against the closure during the insertion of the flow connection body 122 is also shown. This cover element 132 also acts in this case as a stop against which the container 10 is brought and against which it rests during the removal of the liquid from the container. The reference number 128 designates a connecting device with which the hose element 124 is arranged on the flow connection body 122. The cover element 132 can in turn be supported with respect to the second holding device 4 (not shown).

FIGS. 3*a* to 3*e* show a further embodiment of the apparatus according to the invention, in which case, however, the container 10 with the first region 10*a* and the second region 10*b* is also illustrated. In the case of the situation shown in FIG. 3*a* the flow connection body or the removal device respectively has not yet been inserted into the closure 100 of the container 10. In contrast to the embodiment shown in FIGS. 2*a* to 2*c*, in this case the closure 100 has a tubular body 102 which extends into the interior of the container 10. It is evident from FIG. 3*b*, which shows an inserted state of the flow connection body, that the piercing means or the cutting element 126 respectively is likewise inserted into this tubular body 102. This tubular body 102 is used so that when the container is squeezed the liquid can be removed to the maximum degree.

Figure 3A:
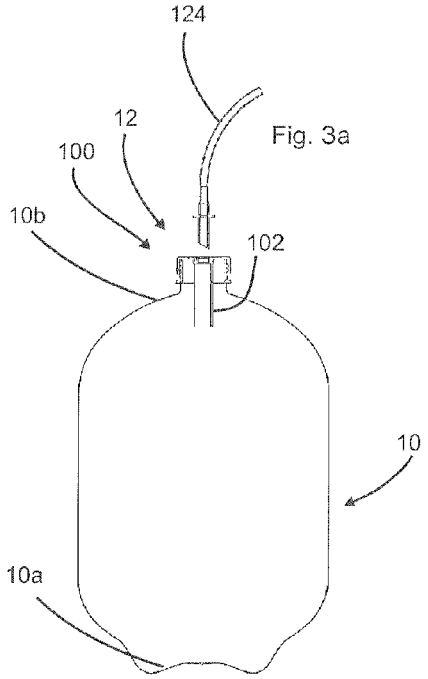
FIGS. 3*a* to 3*e* are five illustrations of an apparatus according to the invention in a second embodiment.
Figure 3B:
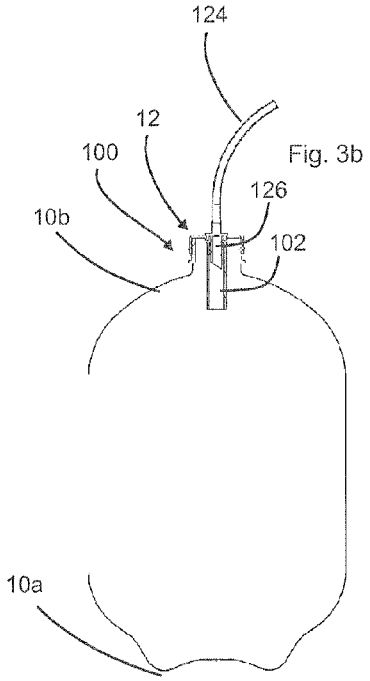
Figure 3C:
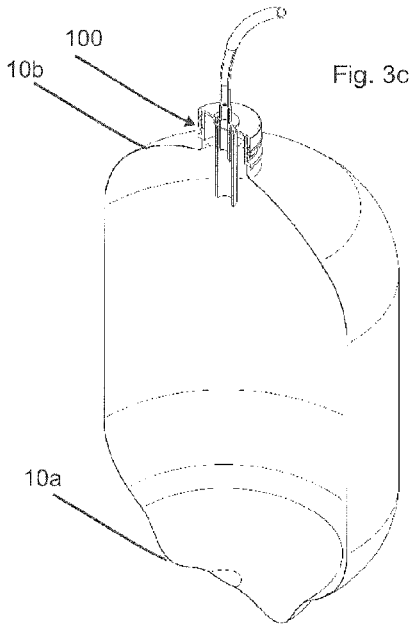
Figure 3D:
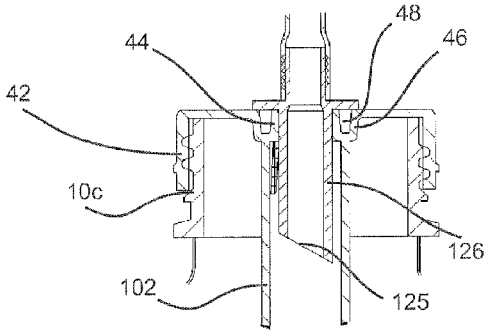

FIG. 3*c* is a perspective illustration of the apparatus shown in FIGS. 3*a* and 3*d*. It is evident that the closure 100 is screwed onto the aperture of the container in this case.

In the case of the detailed illustration shown in FIG. 3*d* it is likewise evident that the container 10 has an external thread 10*c* onto which the closure is screwed, in particular with a peripheral wall 42. The reference number 44 designates an abutment face against which the cutting element 126, which has the cutting edge 125, rests. The reference number 48 designates a recess by means of which a peripheral pressure can be exerted radially inwards upon the cutting element 126. An enlargement of the flow cross-section between the closure 100 and the cutting element 126 during the removal procedure can also be achieved by this shaping of the recess.

Figure 3E:
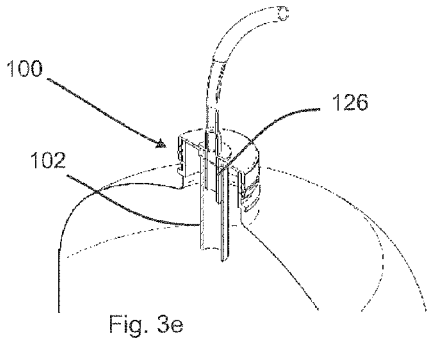

FIG. 3*e* is a further illustration of a container according to the invention with the flow connection body 122 inserted or with the cutting element 126 inserted respectively. It is also evident in this case that the cutting element 126 is inserted into the tubular body 102.

FIGS. 4*a* to 4*d* show a further embodiment of the present invention. In the case of this embodiment it is not absolutely necessary for the container 10 to be squeezed or compressed respectively in order to empty the contents thereof. It would also be possible in this case for a gas to be additionally introduced in order to remove the liquid for removal by way of the tubular body 102 which acts in this case as an ascending pipe. For this purpose a further flow connection could be produced between the container 10 and the surroundings thereof, for example by a second line being inserted into the container, a gaseous medium then being supplied to the container by way of this second line.

In this case it is possible for the tubular body 102 to be made flexible, but it would also be possible for it to be made rigid and to extend into a lower region of the container. In this case it would also be possible for the base 10*a* to be designed in a way other than this in order to make it possible for all the liquid if possible to be capable of being collected by the tubular body 102.

The design of the closure is again similar to the embodiment shown in FIGS. 3*a* to 3*e*. In this case too, the piercing means is inserted into a tubular body 102.

FIGS. 5*a*, 5*b* show a further design of the apparatus according to the invention. In the case of this embodiment a valve designated 70 as a whole and arranged in the closure 100 is opened by the insertion of the flow connection body 122. In this way, a flow connection to the interior of the container is produced.

This valve 70 has in this case a valve body 74 movable in the longitudinal direction L. In a closed state of the valve, connecting channels 76 which can extend for example in the radial direction are covered on the periphery by a peripheral wall 84 which completely surrounds the valve body in the peripheral direction thereof in this case. In the illustration given in FIG. 5*b* these flow connections 76 are freed.

The reference number 82 designates engagement means into which continuous projections 123, which are arranged on a flow connection body 122, can engage, as shown in FIG. 5*b*. In this way, when the flow connection body is withdrawn, the valve 70 can be closed again, or the valve body 74 can be moved upwards respectively. The reference number 78 designates a sealing means which is arranged on the valve body 74, which in this case can be an O-ring. In a closed state of the valve 70 this sealing means 78 rests against the peripheral wall 84 and in this way prevents an escape of liquid between the valve body 74 and the peripheral wall 84.

FIG. 6 is a perspective illustration of the closure with the valve in an opened state. In this case too, it is evident that the flow connections 76 are freed and, in this way, liquid can be drawn upwards through these flow connections. In addition, a continuous recess 77 is also evident in this case, which is attached to these flow connections. On account of this continuous recess the flow cross-section for the liquid to be removed can be increased in an opened state of the valve 70.

In addition, the engagement means 82 is evident in this case, which fixes the valve body 74 to the flow connection body 122 in a closed state.

The Applicants reserve the right to claim all the features disclosed in the application documents as being essential to the invention, insofar as they are novel either individually or in combination with respect to the prior art.

LIST OF REFERENCES

1 apparatus
2 first holding device
4 second holding device
10 container
10*a* base region of the container
10*b* second container region
12 removal device

42 peripheral wall of the closure 100
44 abutment face
48 recess
70 valve
74 valve body
76 connecting channels
77 recess
82 engagement means
84 peripheral wall
100 container closure
102 tubular body
106 sealing closure
108 recess
122 flow connection body
123 projections
124 hose
125 cutting edge
126 cutting element
128 connecting device
132 cover element
L longitudinal direction

The invention claimed is:

1. An apparatus for the removal of liquids from deformable containers, with a first holding device for holding a first region of a container and with a second holding device for holding a second region of the container, wherein the second region is arranged at a distance from the first region, with a removal device for removing liquid from the container and with a drive device which moves the second holding device in a pre-set direction of movement (L) with respect to the first holding device, wherein the removal device is arranged on the apparatus in a removable manner and has at least one single-use component, wherein the at least one single-use component of the removal device is designed and intended to be used only once, wherein the removal device has a flow connection body, wherein the flow connection body is designed in the form of a piercing device, which in order to produce the flow connection with the interior of the container, pierces a closure or at least a wall of the container, wherein the closure is a cap, said cap having a peripheral wall surrounding a mouth opening of the container aligned with a longitudinal axis of the container.

2. The apparatus according to claim 1, wherein only one flow connection is present between the interior of the container and an external space of the container during the removal of the liquid from the container.

3. The apparatus according to claim 1, wherein the removal device has a flexible hose element.

4. The apparatus according to claim 3, wherein the flow connection body projects at least locally into the container in order to remove the liquid.

5. The apparatus according to claim 4, wherein the flexible hose element is attached to the flow connection body.

6. A system for the removal of liquids from containers with an apparatus for the removal of liquids, which has a first holding device for holding a first region of a container, and a second holding device for holding a second region of the container, wherein the second region is arranged at a distance from the first region, and with a removal device for removing liquid from the container, wherein the container has a closure to which a tubular body for the removal of liquid is attached in the interior of the container, wherein the closure is a cap, said cap having a peripheral wall surrounding a mouth opening of the container aligned with a longitudinal axis of the container.

7. The system according to claim 6, wherein the removal device is arranged on the apparatus in a removable manner and at least one element of the removal device is a single-use element.

8. The system according to claim 6, wherein the removal device has a flow connection body which is capable of being inserted into the tubular body.

9. The system of claim 8, wherein the flow connection body has a tubular cutting element with at least one oblique cutting edge.

10. The system of claim 9, wherein the cutting edge is used for piercing a sealing closure which is arranged on a recess of the closure.

11. The system of claim 10, wherein the recess receives the flow connection body or the cutting element, respectively, with a precise fit.

12. The system of claim 10, wherein the recess has an abutment face against which the cutting element, having the cutting edge, rests.

13. The system according to claim 6, wherein the closure has a valve.

14. The system of claim 13, wherein the valve is opened by movement of the removal device, wherein movement of the removal device further comprises an insertion or introduction, respectively, of the removal device or a flow connection body, respectively.

15. The system of claim 13, wherein the container is closed by the valve with an inserted seal, and wherein the container is capable of being filled using the valve.

16. The system of claim 13, wherein the valve is automatically pulled upwards to be closed.

17. The system according to claim 6, wherein the container further comprises at least one external thread onto which the closure is screwed.

18. The system according to claim 17, wherein the closure is screwed via a peripheral wall onto the at least one external thread.

19. The system according to claim 6, wherein the container is a collapsible container.

* * * * *